United States Patent [19]

Skala

[11] 4,451,740

[45] May 29, 1984

[54] DEVICE FOR DETERMINING THE POWER OUTPUT OF A TURBO-GROUP DURING DISTURBANCES IN THE ELECTRICITY SUPPLY NETWORK

[75] Inventor: Karel Skala, Windisch, Switzerland

[73] Assignee: BBC Brown, Boveri & Company, Limited, Baden, Switzerland

[21] Appl. No.: 397,206

[22] Filed: Jul. 12, 1982

[30] Foreign Application Priority Data

Jul. 13, 1981 [CH] Switzerland ..... 4565/81

[51] Int. Cl.[3] ..... F01K 13/02

[52] U.S. Cl. ..... 290/40 C; 290/40 A; 60/707

[58] Field of Search ..... 290/40 R, 40 A, 40 B, 290/40 C; 60/706, 707

[56] References Cited

U.S. PATENT DOCUMENTS 3,657,552 4/1972 Park ..... 290/40 B 3,999,390 12/1976 Braytenbah et al. ..... 60/707 X 4,039,846 8/1977 Uance ..... 60/707 X 4,120,159 10/1978 Matsumoto et al. ..... 290/40 C X 4,132,076 1/1979 Weiss ..... 290/40 A X 4,271,473 6/1981 Ross ..... 290/40 R X

*Primary Examiner*—B. Dobeck

*Assistant Examiner*—W. E. Duncanson, Jr.

*Attorney, Agent, or Firm*—Burns, Doane, Swecker & Mathis

[57] ABSTRACT

Device for determining the power output of a turbo-group during disturbances in the electricity supply network, the working-medium pressures at the beginning and the end of all turbine-sections being utilized, from the time the disturbance breaks out, throughout its duration, and until the signal oscillations die away, in order to generate a signal representing the instantaneous power output of the turbo-group, this signal being employed to implement the regulating function during the disturbance.

3 Claims, 4 Drawing Figures

$$C_i = Q_{i,IC} \cdot (p_{1,i,IC}^2 - p_{2,i,IC}^2)^{-\frac{1}{2}} \cdot \Delta h_{i,IC} \cdot p_{1,IC}^{e_{1,i}} \cdot p_{2,IC}^{e_{2,i}} \cdot (p_{1,i,IC} - p_{2,i,IC})^{-1}$$

$$b_i = P_i,$$

$$C_i = (P_{i,IC} + P_{i,Verl.}) \cdot (p^2_{1,i,IC} - p^2_{2,i,IC})^{-\frac{1}{2}}$$

$$b_i = P_{i,Verl.}$$

$$C_n = (P_{n,IC} + P_{n,Verl.}) \cdot (p^2_{1,n,IC} - p^2_{2,n,IC})^{-\frac{1}{2}}$$

$$b_n = P_{n,Verl.}$$

DEVICE FOR DETERMINING THE POWER OUTPUT OF A TURBO-GROUP DURING DISTURBANCES IN THE ELECTRICITY SUPPLY NETWORK

The present invention relates to a device for determining the power output of a turbo-group during disturbances in the electricity supply network.

When disturbances occur in an electricity supply network which is fed by a turbo-group, it is desirable to determine the mechanical power output throughout the duration of the disturbance, and to match this output to the new load-condition as rapidly as possible, since the signal for the electrical output of the generator, from the measuring instruments which are provided for the normal, undisturbed operation, becomes unusable when a disturbance of this kind breaks out, on account of the powerful uncontrolled oscillations which are associated with such disturbances. Some time elapses before these oscillations have died away. For this reason, it has previously been impossible to maintain the regulation of the output during the disturbance, and for a certain time afterwards.

There is accordingly a need for a device which is capable, in the event of a disturbance of this kind, of matching, as rapidly as possible, the power output of the turbo-group to the new load demand in the supply network.

The present invention, defined in the characterizing clause of Patent claim 1, describes a device which, in the event of a disturbance of this kind, is immediately capable of taking over the function of regulating the power output of the turbo-group.

In the text which follows, the invention is described in more detail, by reference to two versions of the device, for use on steam turbo-groups, these two versions being diagrammatically illustrated in the drawings, in which.

In the device forming the subject of this invention, the power-output measurement relies on determining the values of variables which define the condition of the working medium, namely, in the two embodiments to be described, of the steam.

Figure 1:
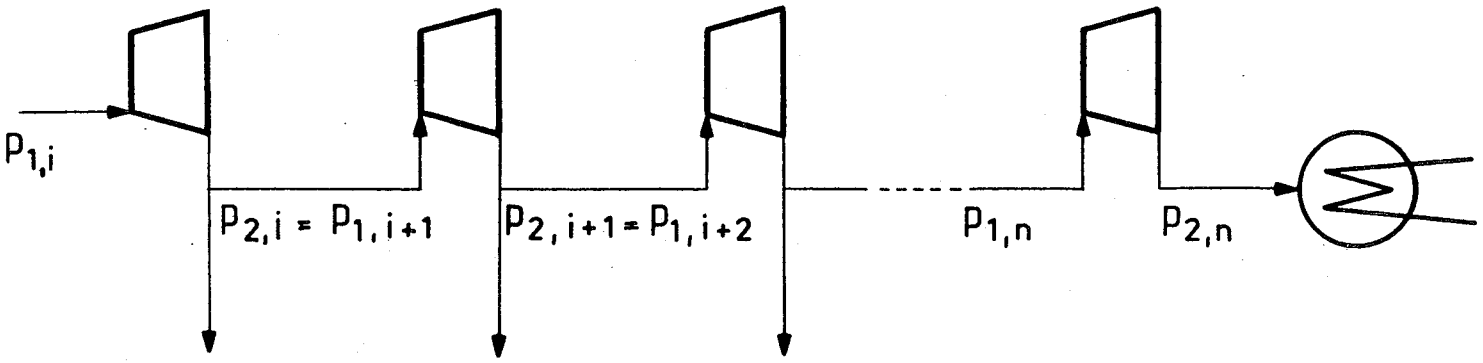
FIG. 1 represents a steam turbo-group, with the pressure-measuring points.
Figure 4:
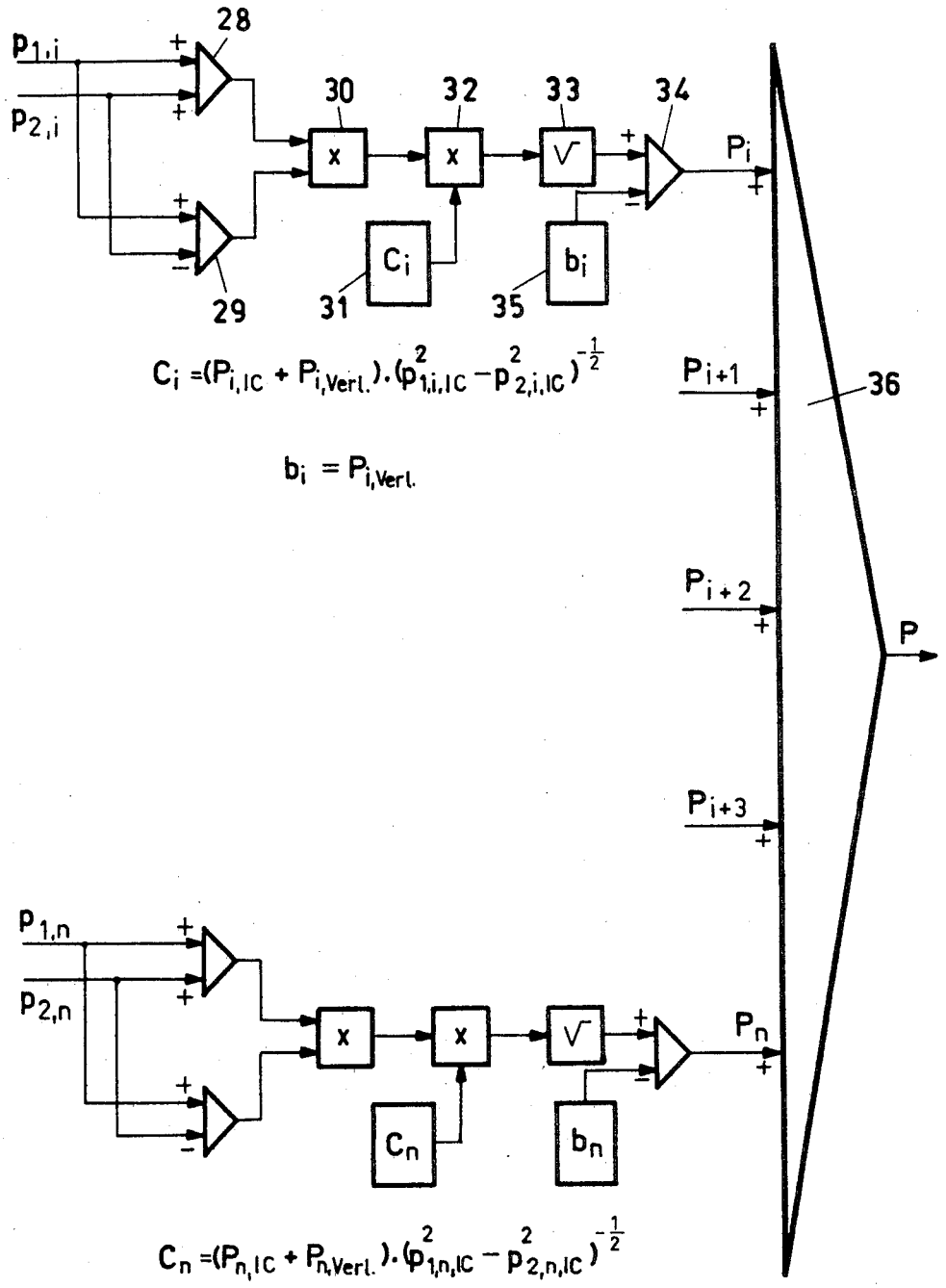
FIG. 4 represents the functional combination of the components for a device, according to the invention, which is constructed more simply than the embodiment according to FIG. 2.

The most simple method, which is employed in the case of the device according to FIG. 4, comprises the determination of the instantaneous mechanical power output P(t) of the turbo-group, solely on the basis of the steam pressures. The bleed-pressures $p_{1,i}$, $p_{2,i}$, $p_{1,i+1}$, $p_{2,i+1}$ etc, see FIG. 1 in this regard, in each case upstream and downstream of a turbine-section, enable, with the aid of the steam cone-law $Q_i(p_i)$, the steam flows $Q_i(t)$ to be calculated, and thereby to calculate, to a first approximation, the power output $P_i(Q_i)$. The term "turbine-section" is to be understood as a section of the turbine between two bleed-points for measuring the steam pressures $p_{1,i}$, $p_{2,i}$ etc.

In the cases in which both valve groups, namely the inlet valves and the stop valves, are scheduled into a throttling position, it is necessary, should a higher accuracy be required, to allow for the fact that pressure conditions prevail in the individual turbine stages, especially upstream of the stop valves, which differ from the conditions prevailing during a conventional control process, in which throttling is accomplished by only the inlet valves, and in which the stop valves are accordingly not operated.

For the abovementioned case, the relationship $$P_i(t)=Q_i(t)\cdot\Delta h_i(t)-P_{i,loss} \tag{1}$$

is used to determine the power output. In this relationship, $\Delta h_i(t)$ is the instantaneous enthalpy difference during polytropic expansion, and $P_{i,loss}$ is the power loss in the turbine-section in question.

The instantaneous enthalpy difference $\Delta h_i(t)$ is difficult to determine, from the measurement-technology point of view, and would also require the measurement of the steam temperature. As a practical way out of this difficulty, an approximation for the instantaneous value of $\Delta h_i(t)$ is accordingly useful. For a region which, from the technical point of view, is reasonably large, in the vicinity of the initial condition, which is identified by the index IC, the following relationship has proved to represent a usable approximation:

$$\frac{h_{1,i}-h_{2,i}}{h_{1,i,IC}-h_{2,i,IC}}\approx\frac{p_{1,i}-p_{2,i}}{p_{1,i,IC}-p_{2,i,IC}}\left(\frac{p_{1,i,IC}}{p_{1,i}}\right)^{e_{1,i}}\left(\frac{p_{2,i,IC}}{p_{2,i}}\right)^{e_{2,i}} \tag{2}$$

In the text which follows, this expression is denoted by $(\Delta h_i/\Delta h_{i,IC})_{Appr}$.

A condition characterized by the index IC is to be understood as a reference condition, in which the values of all the dominating variable quantities are precisely known, for example the steady-state condition at 100% load.

The exponents $e_{1,i}$ and $e_{2,i}$ in (2) are determined by means of a computerized optimization procedure. For a specific case, for example $e_{1,i}$ equals (0.71 and $e_{2,i}$ equals 0.28.

The power loss $P_{i,loss}$ combines the exit losses, the windage losses, and the frictional losses, and can be represented, to an approximation, without any significantly adverse effect on the accuracy, by a constant.

Using the assumptions stated above, the power output of a turbine-section can be expressed in the following manner $$P_i\approx Q_i\times\Delta h_{i,IC}(\Delta h_i/\Delta h_{i,IC})_{Appr}-P_{i,loss} \tag{3}$$

Figure 2:
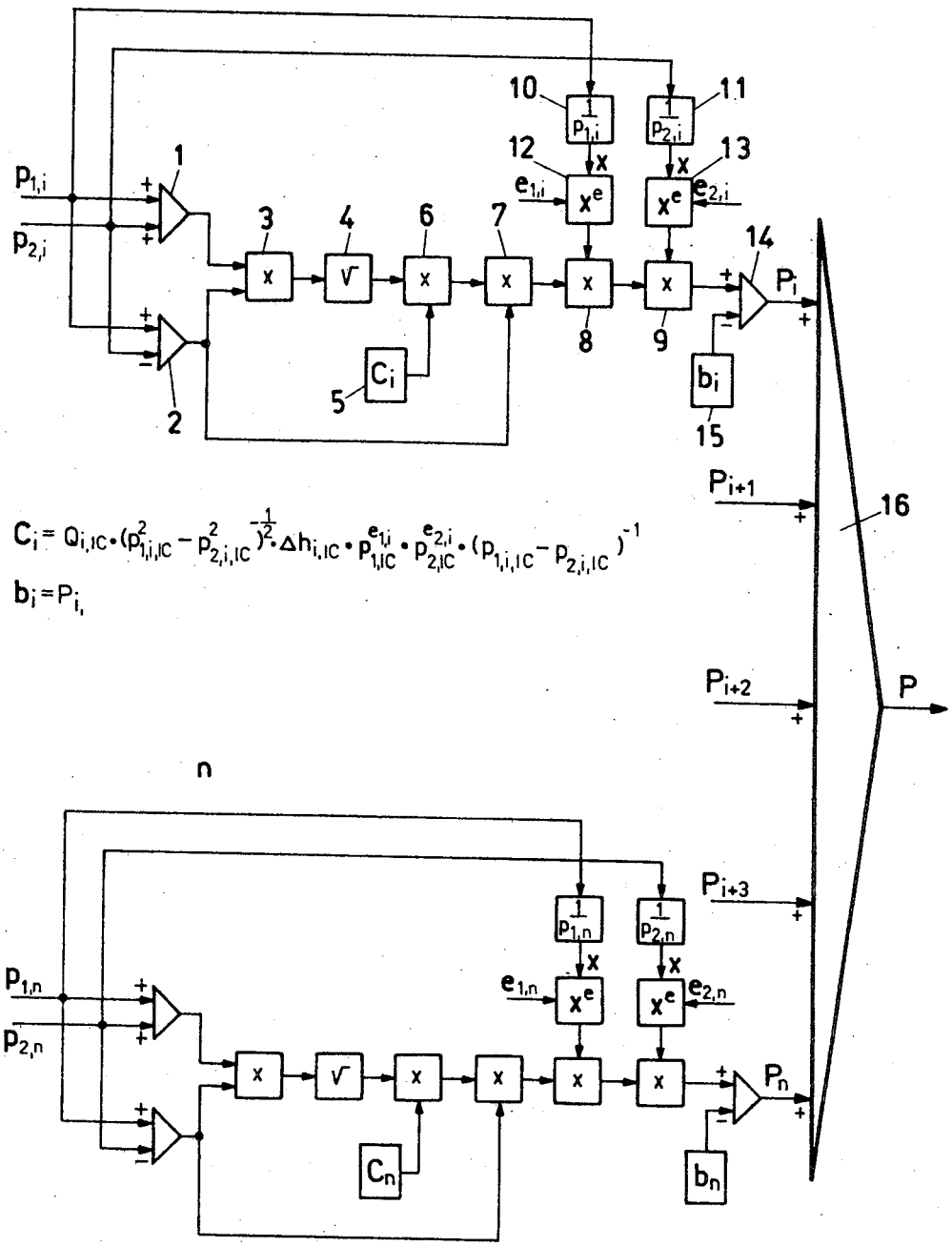
FIG. 2 represents the functional combination of the individual components of a device, according to the invention, which are required for generating a control signal.

The evaluation of this relationship is effected by means of the device, illustrated in FIG. 2, for carrying out the computation-steps expressed by the relationship (3). The components of this device are commercially available products from the field of electronic control systems, it being possible to use both analog-type equipment and analog/digital/analog equipment.

Since only the steam pressures $p_{1,i}$,$p_{2,i}$ etc. are measured, the intention is to use these pressures as the only variable values in the processing of the relationship (3) to produce control signals. Accordingly, the relationship (3) muxt be transformed in such a way that the power output appears in it as a function of the sole variable values $p_{1,i}$, $p_{2,i}$, . . . etc. This transformation is accomplished by means of the following substitutions:

Using $Q_i=K_i\sqrt{p_{1}^{2},_{i}-p_{2}^{2},_{i}}$ (which follows from the steam cone-law), and $Q_{i,IC}=K_i\sqrt{p_{1}^{2},_{i,IC}-p_{2}^{2},_{i,IC}}$, it follows, by ratio-formation, that $$Q_i = Q_{i,IC}\sqrt{(P_{1,i}^2 - P_{2,i}^2)/(P_{1,i,IC}^2 - P_{2,i,IC}^2)}\ .$$

At the same time, the constant $K_i$, which is specific for the turbine-section i, but is virtually valid over the entire power-output range, is eliminated.

From (2), it follows that $(\Delta h_i/\Delta h_{i,IC})_{Appr}$ $$\approx \frac{p_{1,i} - p_{2,i}}{p_{1,i,IC} - p_{2,i,IC}}\left(\frac{p_{1,i,IC}}{p_{1,i}}\right)^{e1,i}\left(\frac{p_{2,i,IC}}{p_{2,i}}\right)^{e2,i}.$$

According to the above, the equation (3) takes, as a function of $p_i$, the form:

$$P_i = \tag{4}$$

$$Q_{i,IC}\sqrt{\frac{p_{1,i}^2 - p_{2,i}^2}{p_{1,i}^2 - p_{2,i,IC}^2}}\ \Delta h_{i,IC}\frac{p_{1,i} - p_{2,i}}{p_{1,i,IC} - p_{2,i,IC}}\left(\frac{p_{1,i,IC}}{p_{1,i}}\right)^{e1,i} \times$$

$$(\ldots) \times \left(\frac{p_{2,i,IC}}{p_{2,i}}\right)^{e2,i}$$

The constant terms of this equation can be gathered together to form the constant $C_i$ indicated in FIG. 2:

$$C_i = Q_{i,IC}(p_{1,i,IC}^2 - p_{2,i,IC}^2)^{-\frac{1}{2}} \times \Delta h_{i,IC} \times p_{1,IC}^{e1,i} \times p_{2,IC}^{e2,i} \times \tag{5}$$

$$(\ldots) \times (p_{1,i,IC} - p_{2,i,IC})^{-1}.$$

If the power loss $P_{i,loss}$ is made equal to $b_i$, Equation (3) reduces to $$P_i \approx C_i\sqrt{p_{1,i}^2 - p_{2,i}^2} \times (p_{1,i} - p_{2,i})p_{1,i}^{-e1,i} \times p_{2,i}^{-e2,i} - b_i. \tag{6}$$

The evaluation of these relationships for all n turbine-sections i, i+1, . . . n, in order to obtain a signal for controlling the power output P of the entire steam turbo-group, can be carried out in the device illustrated, as a block diagram, in FIG. 2, this device comprising n circuits, each containing computer-operation elements 1 to 16. The operations which must be carried out, in each case, by these elements, are indicated by the operators which are entered in the element-blocks in FIG. 2.

The first term $\sqrt{p_{1}^{2},_{i}-p_{2}^{2},_{i}}$ of (6) is computed, in a known manner, by factorization of the radical expression, into $$(p_{1,i}+p_{2,i})(p_{1,i}-p_{2,i})$$

and forming the sum and the difference of $p_{1,i}$ and $p_{2,i}$ in sum-forming elements, that is to say, in an adder 1 and in a subtractor 2, followed by multiplication of these quantities, in a multiplier, and formation of the root in a root-former 4. There then follows, in a multiplier 6, the multiplication of this value with the constant $C_i$, which is supplied by a read-only memory 5, multiplication, in a multiplier 7, with the difference $(p_{1,i}-p_{2,i})$ supplied by the subtractor 2, multiplications, in multipliers 8 and 9, by $p_{1,i}-e1,i$ and $p_{2,i}-e2,i$, these factors being supplied to these multipliers via inverters 10 and 11, to which $p_{1,i}$ and $p_{2,i}$ are fed, and exponentiating elements 12 and 13. In the subtractor 14, this result is reduced by an amount corresponding to the value of the power loss, that is to say, by the constant $b_i$, which is supplied by a second read-only memory 15, and the controller signal P is finally formed, in an adder 16, from the sum of all the $P_i$—values provided by the n circuits.

Figure 3:
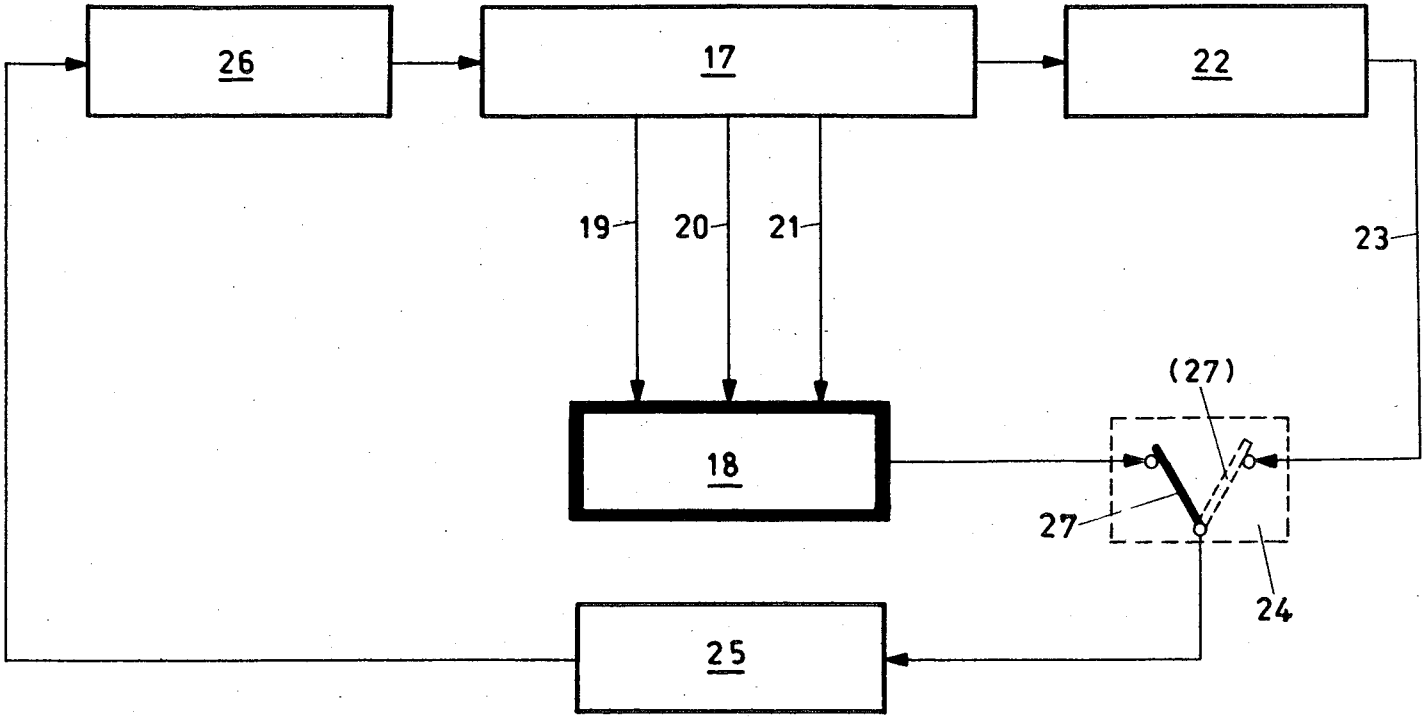
FIG. 3 represents the control loop of the device.

FIG. 3 shows, in a block diagram, the control loop of a steam turbo-group 17, with the device 18 according to the invention. In this control loop, it is assumed that the steam pressures are bled off at two turbine-sections, the pressure-bleed line 19 being provided for the pressure $p_{1,1}$, the pressure-bleed line 20 being provided for the pressure $p_{2,1}$ and, simultaneously, for the pressure $p_{1,2}$, which is the same as $p_{2,1}$, see FIG. 1 with regard to this point, and the pressure-bleed line 21 being provided for the pressure $p_{2,2}$. In the normal, correct operating condition, the generator 22 supplies an output regulator 25 with the instantaneous value of the electrical load, via a signal line 23 and a switch-over relay 24. The control signals of the output regulator 25 pass to the regulating elements of the control-valve group 26, which match the supply of steam entering the turbo-group 17 to the prevailing demand. This form of operation prevails while the electricity supply network is undisturbed, during which operation the contact element 27 of the switch-over relay 24 is located in the position (27) indicated in the drawing by a broken line.

When a disturbance occurs in the supply network, the fault signal, coming from the generator, causes the contact element to switch over, into the position 27, drawn as a solid line, and the automatic control by means of the device 18, according to the invention, then comes into operation.

FIG. 4 shows the diagram of a simplified embodiment of the device, the change in the instantaneous enthalpy difference being neglected when generating the output signal. The sequence of the calculation steps is analogous to that in the case of the device according to FIG. 2, and the relationship, which must be evaluated, is expressed, for one turbine-section i, as follows:

$$P_i = C_i\sqrt{p_{1,i}^2 - p_{2,i}^2} - b_i, \tag{7}$$

in which $b_i=P_{i,loss}$.

Equation (7) is solved, and the constant $C_i$ is found with the aid of the cone-law $Q_i \approx K_i\sqrt{P_{1}^{2},_{i}-p_{2}^{2},_{i}}$, where $Q_i$ equals the flow in the turbine-section i.

To calculate the power output, $P_i$ is made equal to $a_iK_i\sqrt{p_{1}^{2},_{i}-p_{2}^{2},_{i}}-P_{i,loss}$, since the useful power output increases linearly with the flow $Q_i$. If the power loss $P_{i,loss}$ is assumed to be constant, the constant $C_i$ is given, as in the first case, by $P_i/P_{i,IC}$, $P_{i,IC}$ being the power output in an operating condition IC, for example full load, for which the constants $a_i$ and $K_i$ can easily be determined. Since these two constants apply over the entire operating range of interest, the following equation holds good for any desired condition:

$$P_i = K_i \sqrt{p_{1,i}^2 - p_{2,i}^2} - P_{i,loss}$$

and, for a reference condition IC:

$$P_{i,IC} = K_i \sqrt{p_{1,i,IC}^2 - p_{2,i,IC}^2} - P_{i,loss}$$

From these equations, it follows that $$P_i + P_{i,loss} = K_i \sqrt{p_{1,i}^2 - p_{2,i}^2} \text{ and}$$

$$P_{i,IC} + P_{i,loss} = K_i \sqrt{p_{1,i,IC}^2 - p_{2,i,IC}^2} \text{ and}$$

$$\text{from } (P_i + P_{i,loss})/(P_{i,IC} + P_{i,loss}) =$$

$$K_i \sqrt{p_{1,i}^2 - p_{2,i}^2} \;/ K_i \sqrt{p_{1,i,IC}^2 - p_{2,i,IC}^2}$$

it follows, after transformations, for the power output of a turbine-section i:

$$P_i = (P_{i,IC} + P_{i,loss})(p_1{}^2{}_{,i} - p_2{}^2{}_{,i})^{\frac{1}{2}}(p_1{}^2{}_{,i,IC} - p_2{}^2{}_{,i,IC})^{\frac{1}{2}} - P_{i,loss} \quad (8)$$

from which $C_i$ is obtained, since $$C_i = (P_{i,IC} + P_{i,loss})(p_1{}^2{}_{,i,IC} - p_2{}^2{}_{,i,IC})^{-\frac{1}{2}} \quad (9)$$

The control loop corresponds to the loop represented in FIG. 3. The tappings for measuring the pressures are expediently made on the bleed-lines, which are customarily available, for operational reasons, at the beginning and the end of the turbine-sections.

I claim:

1. Device for determining the power output of a turbo-group during disturbances in the electricity supply network, the turbo-group being subdivided into n turbine-sections, a pressure-measuring point for the working-medium pressure being provided, in each case, at the beginning and the end of each turbine-section, in general for monitoring operation, the turbo-group also possessing an automatic control unit (25) and control elements (26), for regulating the power output during normal, undisturbed operation, and featuring a switch-over relay (24), which can be actuated by a signal which is triggered by the disturbance, this relay being designed to activate the device (18) when a disturbance occurs, the turbo-group also featuring pressure-signal lines (19,20,21), which are designed to be pressurized from the above-mentioned pressure-measuring points thereon, while the device (18) features n groups of computing elements, each of which is individually assigned to one of the n turbine-sections, the computer elements (1–16, 28–36) of each group in the device being structured in a manner such that, when a disturbance occurs, they process the pressures ($p_{1,i}$, $p_{2,i}$, $p_{1,i+1}$, $p_{2,i+1}$, . . . $p_{1,n}$, $p_{2,n}$)which are supplied by the pressure-signal lines (19, 20, 21), as input variables, to generate an output signal representing the instantaneous power output $P_i(t)$ of a turbine-section (i), in which device an adder (16;36) is provided, which combines the $P_i(t)$ output signals to generate a resulting output signal representing the instantaneous total power output P(t) of the turbo-group, this signal being intended to be supplied to the automatic control unit (25) of the turbo-group (17), in order to sustain the regulating function throughout the duration of the event producing the disturbance.

2. Device as claimed in claim 1, wherein the computer elements (1–16) of the n groups are, in every case, designed to evaluate the function $$P_i = C_i(p_1{}^2{}_{,i} - p_2{}^2{}_{,i})^{\frac{1}{2}}(p_{1,i} - p_{2,i})p_{1,i}{}^{-e_{1,i}}p_{2,i}{}^{-e_{2,i}} - b_i$$

in which $p_{1,i}$ and $p_{2,i}$ respectively denote the pressures at the beginning and the end of the $i^{th}$ turbine-section, $e_{1,i}$ and $e_{2,i}$ are exponents, determined by an optimization procedure, for respectively, the beginning and the end of the $i^{th}$ turbine-section, the constant $$C_i = Q_{i,IC}(p_{1,i,IC}^2 - p_{2,i,IC}^2)^{-\frac{1}{2}} \Delta h_{i,IC} \cdot p_{1,IC}^{e_{1,i}} \cdot p_{2,IC}^{e_{2,i}} \cdot (\ldots) \cdot (p_{1,i,IC} - p_{2,i,IC})^{-1}$$

in which $\Delta h_{i,IC}$ denotes the enthalpy difference in the turbine section i and the constant $b_i$ denotes the power loss $P_{i,loss}$ in the turbine-section i, while the index IC denotes the value of the variable in question during a steady-state operating condition, for example full load, serving as a reference condition.

3. Device as claimed in claim 1, wherein the computer elements (28–36) of the n groups are, in every case, designed to evaluate the function $$P_i = C_i(p_1{}^2{}_{,i} - p_2{}^2{}_{,i})^{\frac{1}{2}} - b_i$$

in which $p_{1,i}$ and $p_{2,i}$ respectively denote the pressures at the beginning and the end of the $i^{th}$ turbine-section, the constant $$C_i = (P_{i,IC} + P_{i,loss})(p_1{}^2{}_{,i,IC} - p_2{}^2{}_{,i,IC})^{-\frac{1}{2}}$$

the constant $b_i$ denoting the power loss $P_{i,loss}$ in the turbine-section i, while the index IC denotes the value of the variable in question during a steady-state operating condition, for example full load, serving as a reference condition.

* * * * *